US007069762B2

(12) United States Patent
Kutschker

(10) Patent No.: US 7,069,762 B2
(45) Date of Patent: Jul. 4, 2006

(54) BENDING MACHINE

(75) Inventor: Wolfgang Kutschker, Böblingen (DE)

(73) Assignee: RAS Reinhardt Maschinebau GmbH, Sindelfingen (DE)

( * ) Notice: Subject to any disclaimer, the term of this patent is extended or adjusted under 35 U.S.C. 154(b) by 0 days.

(21) Appl. No.: 11/088,590

(22) Filed: Mar. 24, 2005

(65) Prior Publication Data

US 2005/0160782 A1 Jul. 28, 2005

Related U.S. Application Data

(63) Continuation of application No. PCT/EP03/06730, filed on Jun. 26, 2003.

(30) Foreign Application Priority Data

Sep. 26, 2002 (DE) ..... 102 45 778

(51) Int. Cl.
*B21D 5/04* (2006.01)

(52) U.S. Cl. ..... 72/319; 72/453.02

(58) Field of Classification Search ..... 72/319, 72/453.04, 453.03; 100/271
See application file for complete search history.

(56) References Cited

U.S. PATENT DOCUMENTS 3,512,476 A * 5/1970 Georg ..... 100/270
3,613,365 A 10/1971 Costa
4,210,007 A * 7/1980 Michel ..... 72/15.2
4,488,237 A 12/1984 Aronson et al.
4,559,807 A * 12/1985 Ganago et al. ..... 72/454
5,092,151 A 3/1992 Catti et al.
5,199,293 A * 4/1993 Catti et al. ..... 72/443
5,927,135 A 7/1999 Kutschker
6,516,648 B1 2/2003 Kutschker et al.

FOREIGN PATENT DOCUMENTS

| | | |
|---|---|---|
| DE | 3837603 A1 | 5/1990 |
| DE | 4206417 A1 | 9/1993 |
| DE | 19640124 A1 | 4/1998 |
| DE | 19901796 A1 | 7/2000 |
| WO | WO 92/00154 | 1/1992 |

* cited by examiner

*Primary Examiner*—Daniel C. Crane
(74) *Attorney, Agent, or Firm*—Reinhart Boerner Van Deuren P.C.

(57) ABSTRACT

The invention concerns a bending machine comprising a machine frame, an upper bar equipped with a tool and a lower bar likewise equipped with a tool, the upper bar and the lower bar being mounted mutually mobile on the frame. The machine comprises at least one drive means for moving the tools of the lower and upper bars towards each other, so as to shape a plate-shaped part to be machined located between said tools. The invention aims at providing that the force exerted by the tools of the lower and upper bars should be the highest possible, at the least possible cost. Therefor, the drive means comprises at least one displacement drive element, to develop an opening and closing movement of the upper bar and the lower bar relative to each other, and at least one force drive element to exert a higher force that that of the displacement drive element, so as to shape the part to be machined which is located between the upper bar tool and the lower bar tool, the displacement drive element being immobilized and locked during the forming operation.

21 Claims, 7 Drawing Sheets

BENDING MACHINE

This application is a continuation of international application number PCT/EP2003/006730 filed on Jun. 26, 2003.

The present disclosure relates to the subject matter disclosed in international application number PCT/EP2003/006730 of Jun. 26, 2003 and German application number 102 45 778.6 of Sep. 26, 2002, which are incorporated herein by reference in their entirety and for all purposes.

BACKGROUND OF THE INVENTION

The invention relates to a bending machine comprising a machine frame, an upper beam having an upper beam tool and a lower beam having a lower beam tool, the upper beam and the lower beam being mounted such that they can move relative to one another on the machine frame, and at least one drive for moving the upper beam tool and the lower beam tool toward one another in order to act on a workpiece made from flat material and located between the two beams.

Bending machines of this type are known from the prior art. In these bending machines, the drive is usually dimensioned such that it can generate sufficient forces to hold a workpiece securely between the upper beam and the lower beam.

However, this solution has the drawback that if a speed of the relative movement between upper beam and lower beam which is required for the desired processing times of the workpieces is to be reached, the forces with which the upper beam tool and the lower beam tool can act on the workpiece are limited or require a level of outlay which is not economically justifiable.

Therefore, the invention is based on the object of improving a bending machine of the generic type in such a manner that forces which are as high as possible are applied to the workpiece by the upper beam tool and lower beam tool at the lowest possible cost.

SUMMARY OF THE INVENTION

In a bending machine of the type described in the introduction, this object is achieved, according to the invention, by virtue of the fact that the at least one drive comprises at least one displacement drive for generating an opening and closing movement of the upper beam and the lower beam relative to one another and at least one force drive for generating a greater force than the displacement drive in order to deform the workpiece disposed between the upper beam tool and the lower beam tool, and in that the displacement drive is stationary and blocked during deformation.

The advantage of the solution according to the invention is to be regarded as residing in the fact that the displacement drive can generate a rapid relative movement between upper beam and lower beam, whereas the force drive opens up the additional option of applying high forces to the workpiece by the upper beam tool and lower beam tool in order thereby to be able to deform this workpiece.

In this context, the term deform is to be understood as meaning shaping of a workpiece by the interaction of upper beam tool and lower beam tool. Deformation of this nature comprises, for example, closing and compression of bends or folds, stamping of beads or any other form of deformation operations carried out on flat materials.

The force drive can be of particularly expedient configuration if the force drive is formed such that during the generation of a force which moves the upper beam tool and the lower beam tool toward one another, its speed of displacement is lower than that of the displacement drive.

This in particular enables the driving power for the force drive to be kept at a low level despite the large force generated and also allows the rapid displacement movements which take place over long displacement distances to be transferred to the displacement drive.

It is particularly expedient if the force that can be generated by the force drive exceeds the force that can be generated by the displacement drive by a factor of at least two, preferably at least five, even more preferably at least ten.

In the explanation of the invention which has been given thus far, no further details have been provided as to the way in which the drive is disposed relative to the upper beam and the lower beam. An advantageous exemplary embodiment provides that the at least one drive, which comprises in each case one displacement drive and one force drive, is disposed at an end of the upper beam.

This could be configured such that the drive is disposed only on one side of the upper beam and of the lower beam. It is particularly expedient if in each case one of the drives according to the invention is disposed on both sides of the upper beam and the lower beam.

Thus far, no further details have been given as to the way in which the displacement drive and force drive are disposed relative to one another. By way of example, it would be conceivable for the force drive to be disposed in such a way that it is operative in any partial region between a beam and the tool associated with this beam, whereas the displacement drive serves to move the upper beam and lower beam toward one another.

However, it is particularly advantageous if the force drive and the displacement drive are combined to form a drive unit which as a whole is operative only between the upper beam and the lower beam, so that both the force drive and the displacement drive effect a relative movement between the upper beam and the lower beam.

Where the present invention speaks of the drive unit effecting a relative movement of the upper beam with respect to the lower beam, and in so doing acts on the upper beam and the lower beam, it is not necessarily imperative that the drive unit must only act directly on the upper beam and the lower beam. In many cases, one of the beams, in particular the lower beam, is fixedly connected to the machine frame. In a situation of this nature, the drive unit likewise acts only between upper beam and lower beam in the context of the invention if the drive unit engages on the machine frame, since the latter is fixedly connected to one of the beams and therefore the drive unit is also connected between this beam that is fixedly connected to the machine frame and the movable beam.

No further details have been given as to the configuration of the displacement drive itself.

To ensure that the force drive can become active when the displacement drive is inactive and therefore blocked, an advantageous solution provides for the displacement drive to comprise a blocking device which is active when the drive is stationary. This blocking device creates the possibility of ensuring that the displacement drive, in any event when stationary, does not execute any movement whatsoever and therefore the entire force of the force drive can become active.

As an alternative or in addition to the provision of a blocking device, another favorable solution provides that the displacement drive is blocked by a self-locking action when it is stationary. This solution has the advantage that the blocking device can be dispensed with or at least, if it is still present for safety reasons, can be configured in such a way that the forces which it has to absorb are lower.

No further details have been provided as to the configuration of the displacement drive. A particularly expedient solution provides that the displacement drive is formed as a spindle drive, comprising a threaded spindle and a spindle nut.

This solution is particularly expedient if the spindle nut is drivable by a drive motor.

To generate a self-locking action in the region of the drive of the spindle nut, an expedient solution provides that the spindle nut is driven by means of a self-locking transmission.

Thus far, no further details have been given as to the configuration of the force drive. According to a particularly expedient solution, the force drive is formed as a hydraulic drive.

To make the hydraulic drive as small and compact as possible, it is preferably provided that the hydraulic drive comprises a plurality of piston surfaces which act in parallel.

The hydraulic drive could be active indirectly, i.e. via an intermediate transmission, but it is particularly expedient if the hydraulic drive is disposed so as to act directly in the drive unit, i.e. the hydraulic drive itself effects the relative movement of upper beam and lower beam, without the need for any intermediate transmission.

To allow efficient operation of the hydraulic drive, it is preferably provided that a hydraulic unit of the hydraulic drive be disposed at one of the beams.

As an alternative to providing a directly operating hydraulic drive, in another preferred exemplary embodiment of the solution according to the invention it is provided that the force drive comprises a lever transmission with a drive for this.

In this case, the drive for the lever transmission may either be a pivot drive or a linear drive. It is even conceivable for the linear drive provided to be a pneumatically or hydraulically actuable cylinder.

A very wide range of solutions are conceivable with regard to the control of the bending machine according to the invention having the displacement drive and the force drive.

By way of example, it would be conceivable for the displacement drive and force drive to be used in parallel. In this case, however, it would be necessary for the displacement drive to be formed to be self-locking, so that the force drive can then act with the greater force in any position of the displacement drive.

The bending machine according to the invention can be made simpler if a control unit is provided, which actuates either the displacement drive or the force drive, so that in particular the displacement drive does not have to operate under conditions in which the greater force of the force drive is active.

To allow controlled use of the high force that can be generated by the force drive, it is preferably provided that the force that can be generated by the force drive can be controlled by the control unit, so that the use of the full force of the force drive can be effected in a controlled manner only during the respectively corresponding processing operations.

A particularly advantageous solution in this respect provides for the control unit to use the force drive as a function of the respective processing operation.

This would provide the option, for example, of performing the fixing using the displacement drive, which generates sufficient force, during normal bending operations using a bending beam, in which the workpiece is merely clamped, i.e. fixed, between upper beam tool and lower beam tool, and consequently the force drive need not be used at all for this purpose.

In this case, the force drive is then only used in situations in which deformation of the workpiece, i.e. for example bending of a fold, closing of a fold or any type of further deformation processes is to be carried out by the upper beam tool and the lower beam tool.

However, in order not to make the control outlay excessively complex, in another advantageous exemplary embodiment of a bending machine according to the invention it is provided that the control unit finally actuates the force drive during clamping of the workpiece in order for the latter to be bent by means of a bending beam, so that the force drive is always ultimately responsible for generating the force which acts on the workpiece.

As an alternative or in addition to the above, it is provided that the control unit finally actuates the force drive each time the workpiece is acted on by means of the upper beam tool and the lower beam tool in order to be processed, so that in any event the force that can be generated by the force drive can be utilized for the processing.

Further features of the invention form the subject matter of the following description and of the illustration in the drawing of a number of exemplary embodiments.

DETAILED DESCRIPTION OF THE INVENTION

Figure 1:
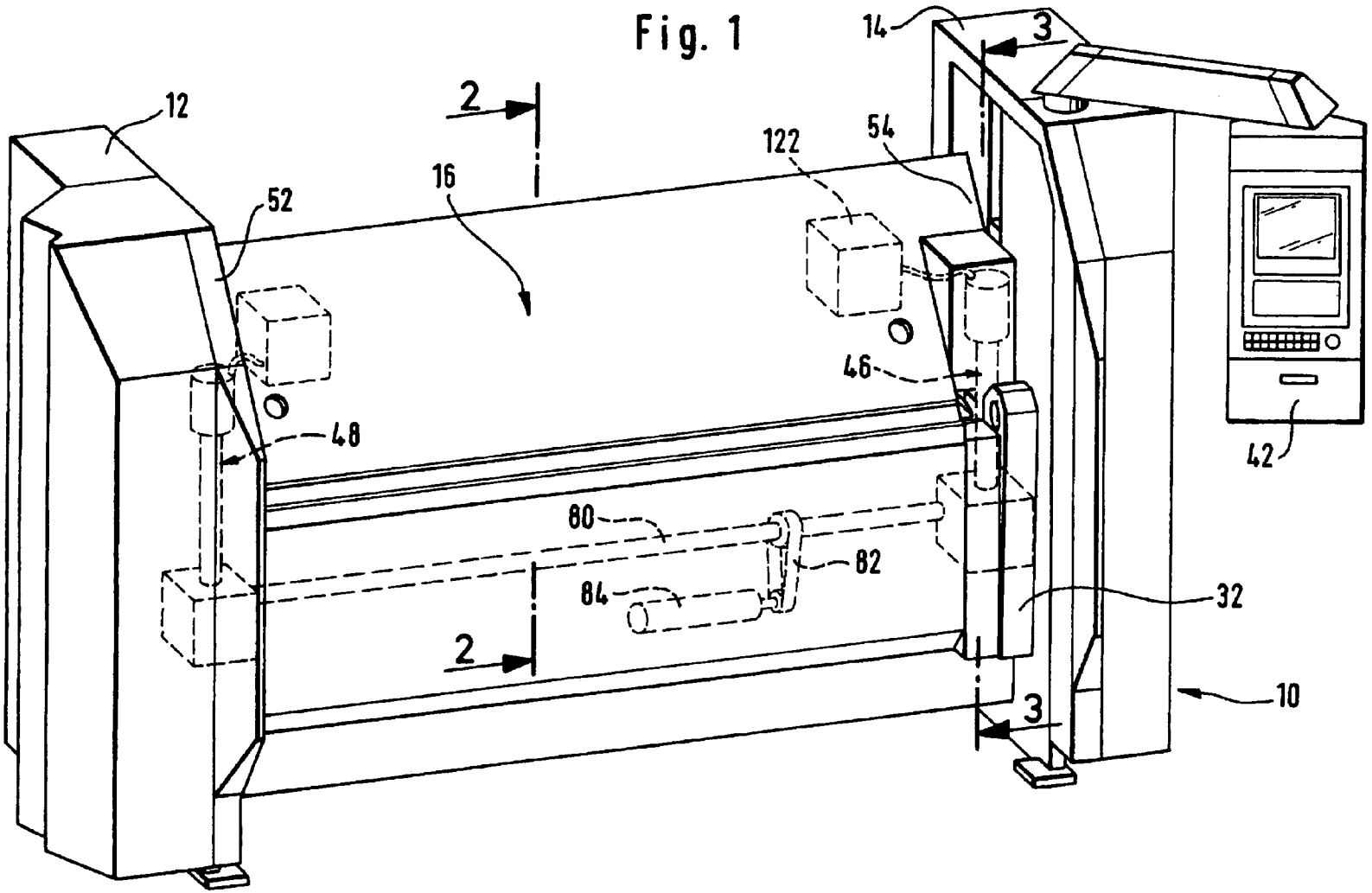
FIG. 1 shows a perspective front view of a bending machine according to the invention.
Figure 2:
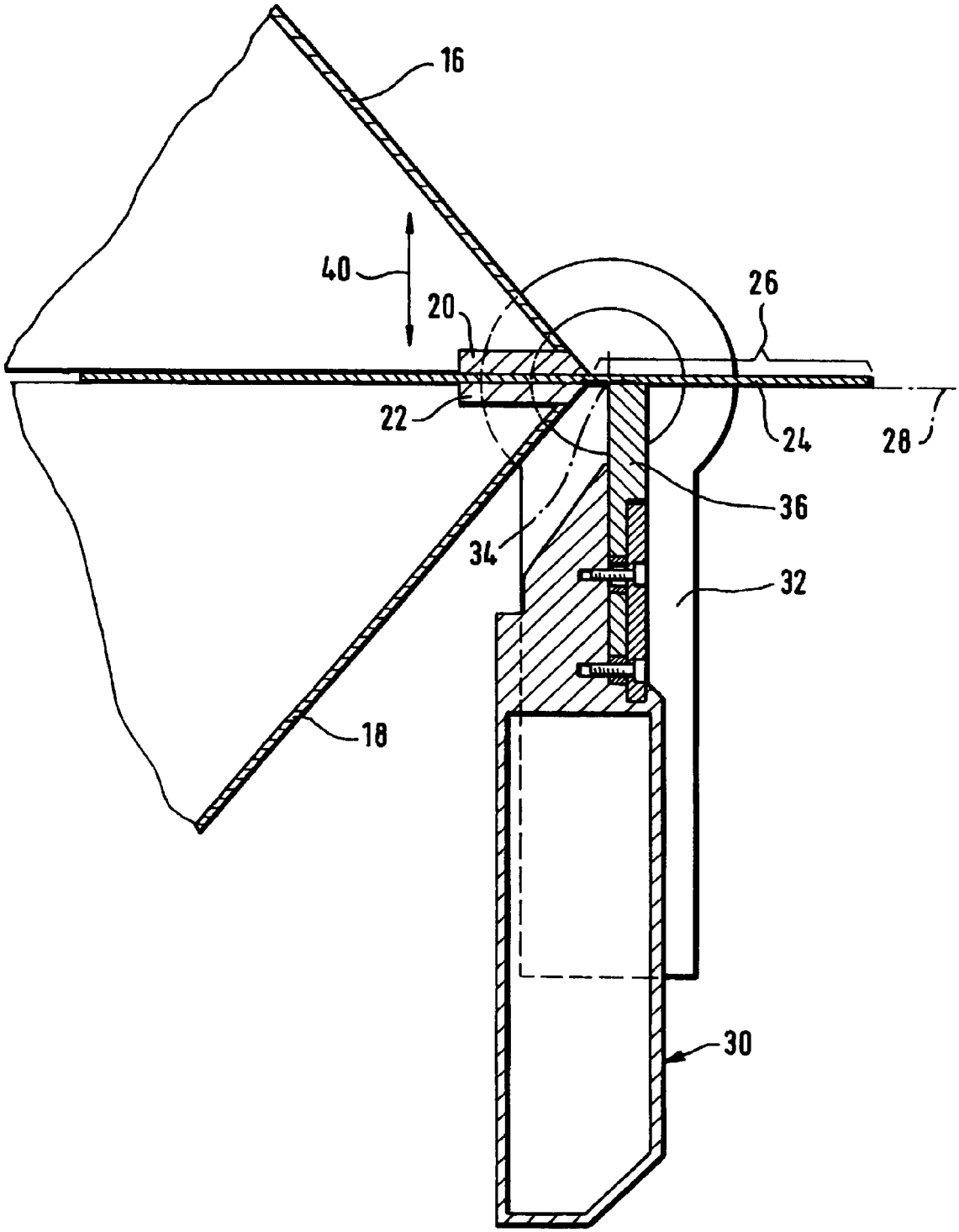
FIG. 2 shows a section on line 2—2 in FIG. 1.

An exemplary embodiment of a bending machine according to the invention, illustrated in FIG. 1, comprises a machine frame which is denoted overall by 10 and has side columns 12 and 14, between which, as illustrated in FIG. 2, an upper beam 16 and a lower beam 18 extend.

By way of example, the lower beam 18 is fixedly connected to the columns 12 and 14, while the upper beam 16 is movable relative to the lower beam 18.

Furthermore, the upper beam 16 carries an upper beam tool 20 and the lower beam 18 carries a lower beam tool 22, between which a workpiece 24 made from flat material, for example from sheet metal, can be clamped in such a way that a strip of this material which projects beyond the upper beam tool 20 and the lower beam tool 22 can be bent out of a plane 28 that can be defined by the lower beam tool 22 and the upper beam tool 20.

For this purpose, the bending machine is provided, for example, with a bending beam 30, which extends between bending beam holders 32 disposed at its ends and can move with these bending beam holders 32 about a pivot axis 34, the pivot axis 34 preferably lying above the clamping plane 28.

The bending beam in this case acts, by means of a bending beam tool 36, on the strip 26 of the workpiece that is to be bent over, with the entire bending beam 30 being pivotable about the pivot axis 34.

To displace the upper beam 16 in a direction of movement 40 relative to the lower beam 18, so that the workpiece 24 is either acted on by the upper beam tool 20 of the upper beam 16 and pressed onto the lower beam tool 22 of the lower beam 18, or the workpiece 24 can move freely between the upper beam 16, which has been lifted off the lower beam 18, and the lower beam 18 itself, the bending machine according to the invention is provided with a drive, which is controllable by a control unit 42 and comprises two drive units 46 and 48, which are in each case disposed in end regions 52 and 54 of the upper beam 16 and of the lower beam 18 and effect a relative movement between the upper beam 16 and the lower beam 18, in the situation illustrated by way of example cause the upper beam 16 with the upper beam tool 20 to be lifted off the workpiece 24 resting on the lower beam 18 with the lower beam tool 22, or cause the upper beam tool 20 to act on the workpiece 24 toward the lower beam tool 22.

Figure 3:
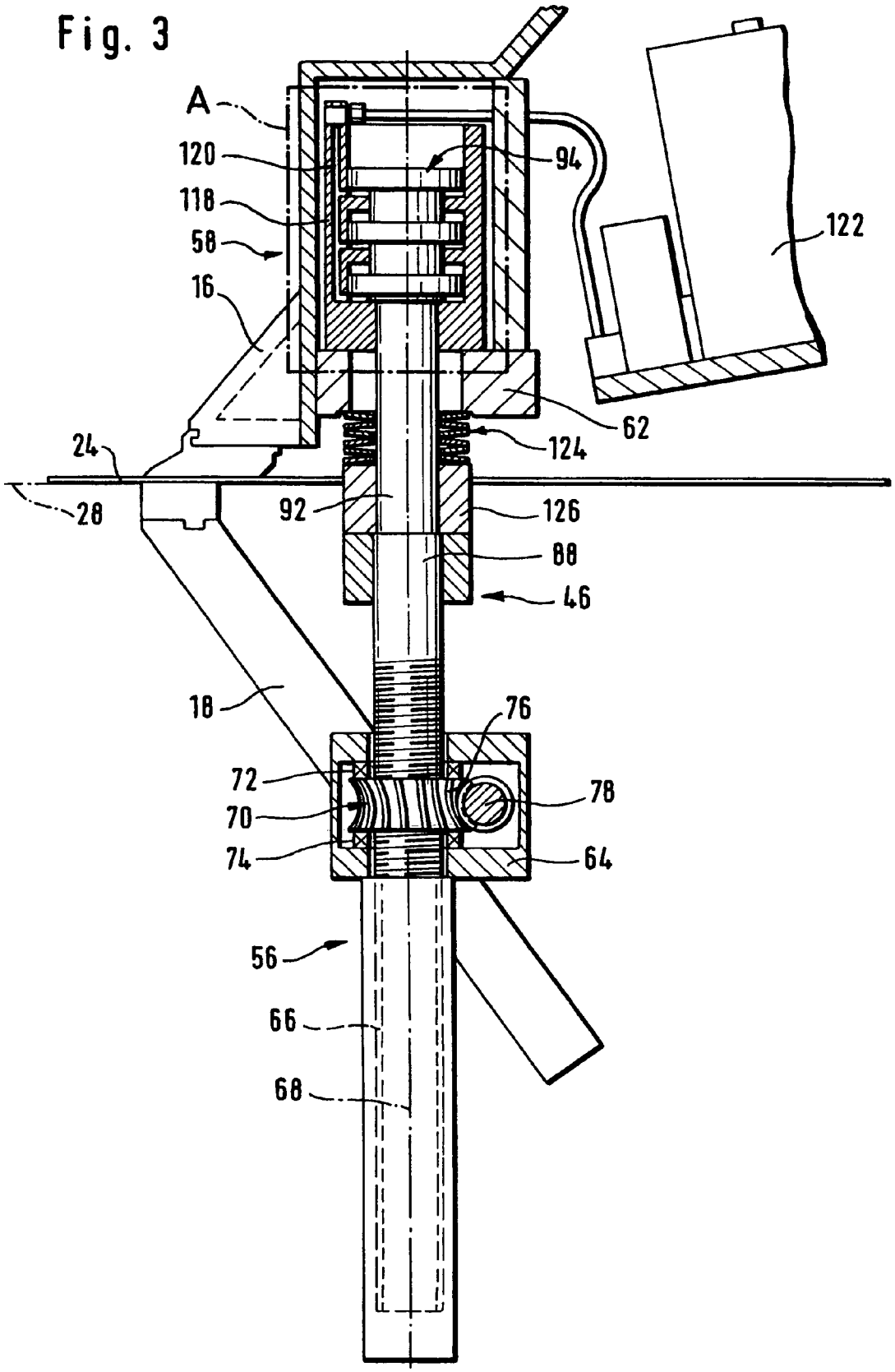
FIG. 3 shows a section on line 3—3 in FIG. 1 for a first exemplary embodiment of a bending machine according to the invention.

In a first exemplary embodiment of a bending machine according to the invention, illustrated in FIG. 3, each of the drive units, in this case the drive unit 46 illustrated, comprises a displacement drive 56 and a force drive 58, the two of which are directly coupled to one another, so that the drive unit 46 on one side acts on a bearing element 62, which is fixedly connected to the upper beam 16, and on the other side acts on the lower beam 18 via a bearing element 64 fixedly connected to the lower beam 18.

The drive unit 46 is in this case constructed in such a way that both the displacement drive 56 and the force drive 58, either alternately or together, act on the bearing element 62 and on the bearing element 64, depending on how they are actuated by the control unit 42.

In the first exemplary embodiment, illustrated in FIG. 3, the displacement drive 56 comprises a threaded spindle 66 which is held nonrotatably and extends with its longitudinal axis 68 running transversely with respect to the clamping plane 28, passing through a spindle nut 70, which is held such that it cannot slide in the direction of the longitudinal axis 68 of the threaded spindle 66 by two bearings 72 and 74 but can rotate about the longitudinal axis 68 in the bearing element 64, which is formed as a bearing housing.

Driving of the spindle nut 70 and therefore rotation of the latter relative to the threaded spindle 66 then effects displacement of the threaded spindle 66 in the direction of its longitudinal axis 68 and therefore in the direction toward the upper beam 16 or away from the upper beam 16.

For the spindle nut 70 to be driven in rotation, the spindle nut is provided on its peripheral side with external toothing 76 in which a worm 78 engages, so that the worm 78 and the external toothing 76 together form a worm transmission.

The worm 78 can be driven by a common drive shaft 80, which extends between the two drive units 46 and 48 and for its part is drivable, via a step-down transmission 82, by a motor 84, so that the spindle nuts 70 of the two drive units 46 and 48 can always be driven synchronously with one another by means of the motor 84.

The displacement drive 56 as a whole, i.e. the combined unit made up of threaded spindle 66, spindle nut 70, worm transmission 76, 78, step-down transmission 82 and motor 84, is formed in such a way that when the motor 84 is stationary, on account of the self-locking action it blocks a movement of the threaded spindle 66 in the direction of its longitudinal axis 68.

Figure 4:
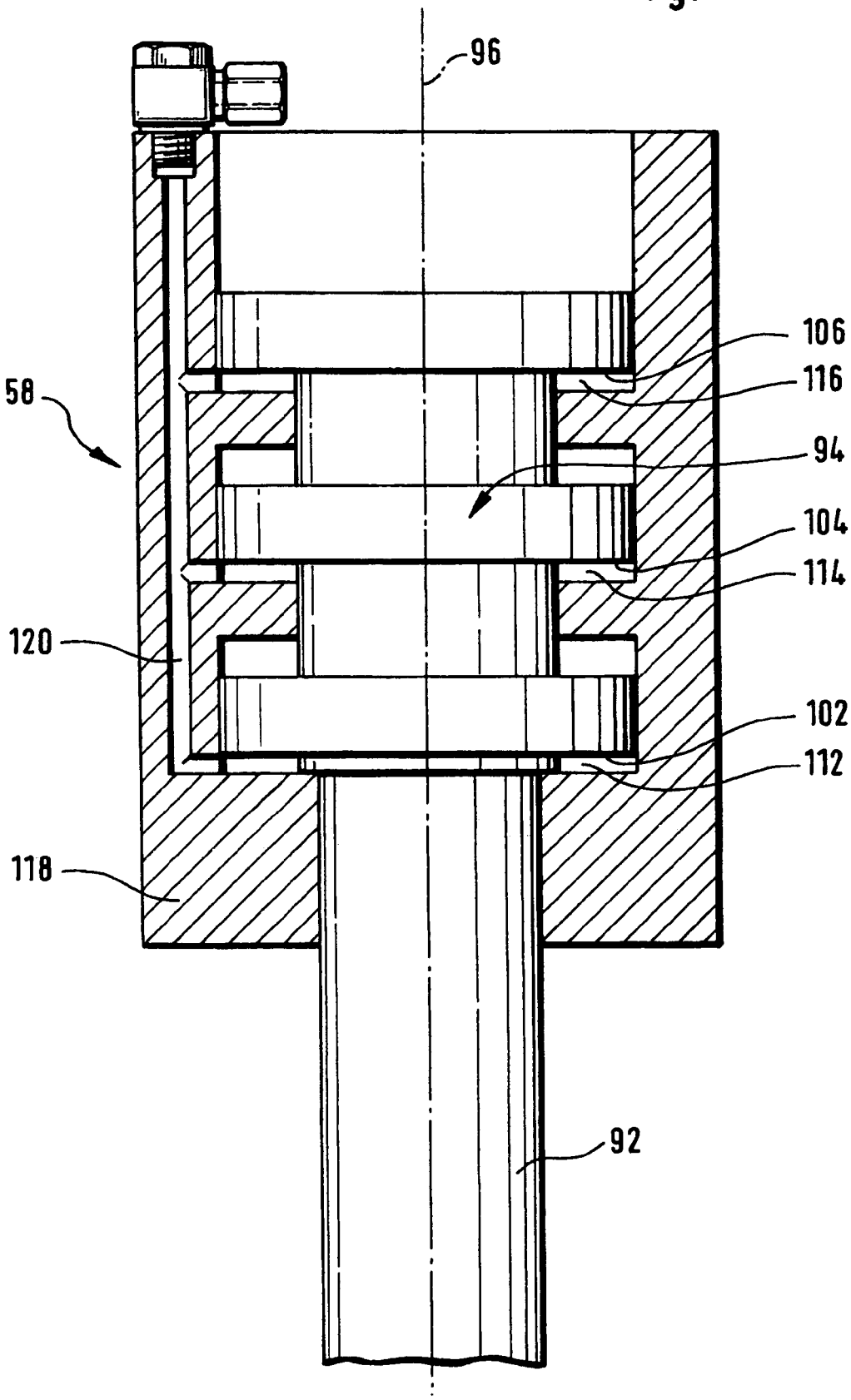
FIG. 4 shows an enlarged illustration of a region A in FIG. 3.

The threaded spindle 66 is fixedly connected by one end 88, preferably the end 88 facing the upper beam 16, to a piston rod 92 of a triple piston 94, which, as illustrated in FIGS. 3 and 4, comprises three annular piston surfaces 102, 104, 106 which are disposed in succession in the direction of a longitudinal axis 96 of the piston rod 92 and facing which are disposed cylinder chambers 112, 114, 116 in a cylinder housing 118, it being possible for hydraulic medium to be fed to the cylinder chambers 112, 114, 116 simultaneously via a distribution passage 120 in the cylinder housing 118, so that a considerable force can be generated with a small configuration of the force drive 58 by medium being applied to the piston surfaces 102, 104, 106.

The cylinder chambers 112, 114, 116 are fed by a hydraulic unit 122, which is preferably disposed located at the upper beam 16 and is actuable by the control unit 42, in order to generate pressurized hydraulic medium so as to move the piston 94 relative to the cylinder housing 118.

The cylinder housing 118 for its part is located on the bearing element 62 fixedly connected to the upper beam 16, specifically on a side of the bearing element 62 which is remote from the lower beam 18, so that application of hydraulic medium to the cylinder chambers 112, 114, 116 leads to the cylinder housing 118 acting on the bearing element 62 and causing it, together with the upper beam 16, to move toward the lower beam 18, so that the cylinder housing 118 is displaced relative to the piston rod 92 in the direction of the lower beam 18.

Furthermore, a set of disk springs 124 is provided on an opposite side of the bearing element 62 from the cylinder housing 118, which set of disk springs 124 is supported on one side against the bearing element 62 and on the other side against a support ring 126, which simultaneously produces a connection to the end 88 of the spindle 66.

The set of disk springs 124 causes the bearing element 62, together with the upper beam 16, to move in the direction away from the lower beam 18 when the cylinder chambers 112, 114, 116 are unpressurized and therefore the cylinder housing 118 can move toward the piston 94 and away from the lower beam 18.

The dimensions of the set of disk springs 124 are such that without pressure being applied to the cylinder chambers 112, 114, 116 the cylinder housing 118 is displaced away from the lower beam 18 until it comes to a mechanical stop.

Furthermore, by way of example, the threaded spindle 66 is fixed such that it cannot rotate relative to the upper beam 16 by means of a nonpositive lock effected by the prestressed set of disk springs 124, which fixes the unit composed of support ring 126, piston rod 92 and threaded spindle 66 such that it cannot rotate with respect to the bearing 62.

In the solution according to the invention, it is now possible to use the displacement drive 56 to move the upper beam 16 and the lower beam 18 very quickly relative to one another, for example at speeds of the order of magnitude of 50 to 100 mm/sec, without this displacement drive 56 being able to apply high forces, so that it is impossible for a high force to be generated between the upper beam tool 20 and the lower beam tool 22.

However, for many bending operations carried out by means of the bending beam 30 for example, the force is sufficient to clamp the workpiece 24.

If high forces are required, the force drive 58 can be used, this drive being able to generate a force which is more than double, preferably more than five times, particularly preferably more than ten times, that of the displacement drive 56. However, the force drive 58 only allows velocities of the relative movement between the upper beam 16 and the lower beam 18 in the region of a few millimeters per second or less.

Figure 5:
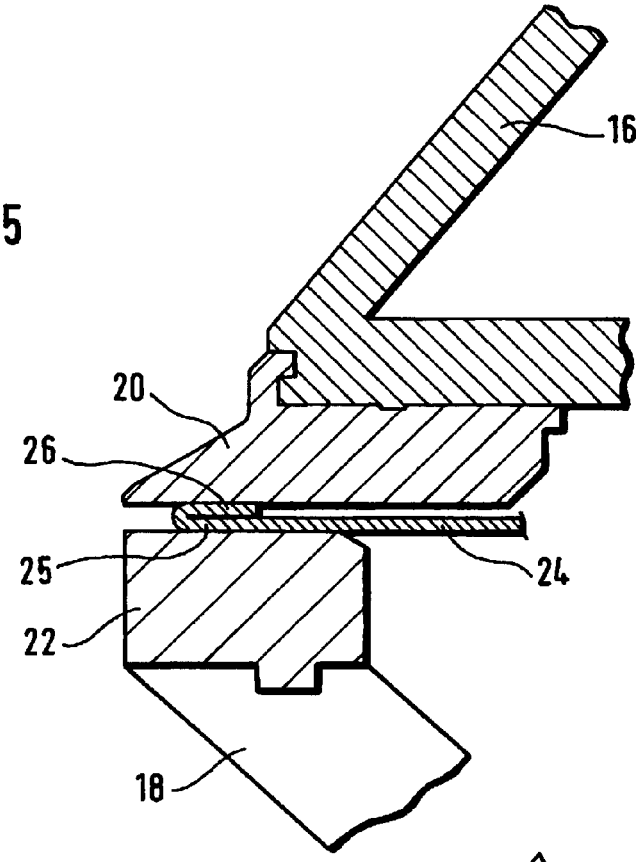
FIG. 5 shows an illustration of an excerpt from a first example of a deformation on the basis of a section similar to that shown in FIG. 3 in the region of upper beam tool and lower beam tool.
Figure 6:
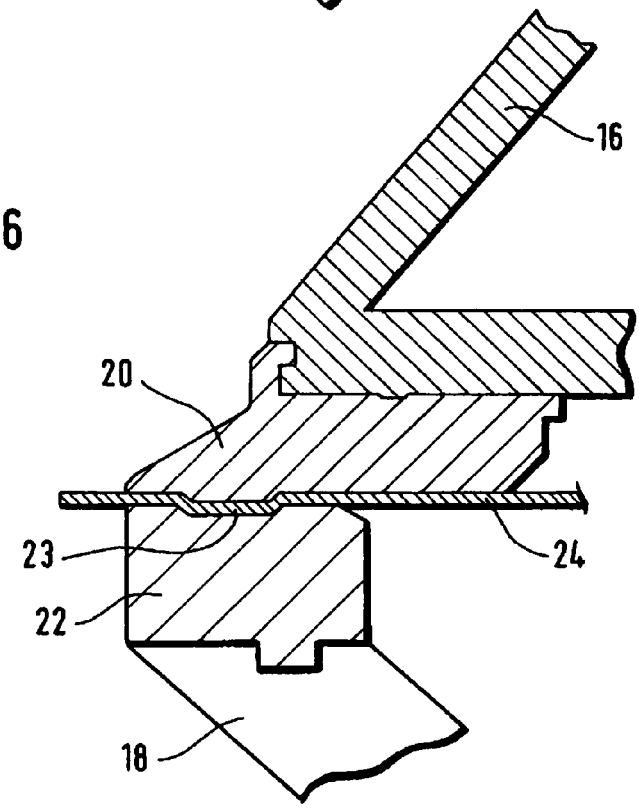
FIG. 6 shows an illustration similar to that shown in FIG. 5 of a second example of a deformation.

The much higher force which can be generated by the force drive 58 offers the advantage, however, of realizing, with the bending machine, as illustrated in FIG. 5 or FIG. 6, also additional operations, for example deformation of the workpiece. By way of example, it is possible, as illustrated in FIG. 5, to bend over the workpiece 24 between the upper beam tool 20 and the lower beam tool 22, i.e. to press together a strip 26 which has been bent over onto the workpiece 24 over a region 25, thereby effecting what is known as a closed fold without any cavity between the strip 26 and the region 25 of the workpiece 24.

On the other hand, however, it is also possible, for example, as illustrated in FIG. 6, to stamp a bead 23, for example, into the workpiece 24 by means of the force drive 58 by suitable shaping of the upper beam tool 20 and lower beam tool 22.

In the simplest case, the force drive 58 is always used with the displacement drive 56 stationary, without the force of the force drive 58 having any adverse effect on the displacement drive 56 such that the latter would likewise be displaced, since—as has already been explained—the displacement drive 56 is formed to be self-locking.

In principle, given a self-locking form of the displacement drive 56, it would also be conceivable, in parallel with the displacement drive, for example while the workpiece 24 is being acted on by the upper beam tool 20 in order to be pressed onto the lower beam tool 22, to start up the force drive 58 at the same time as and in addition to the displacement drive 56, but on account of the force action of the force drive 58 this would lead to the displacement drive 56 being blocked when the force drive 58 unfurls its full force, and therefore to the motor 84 likewise being blocked.

Furthermore, in one particular embodiment of the solution according to the invention, it is also conceivable for the hydraulic unit 122 to be formed in such a way that it can be used to predetermine the force generated by the force drive 58 in a metered and controlled way, so that different forces generated by the force drive 58 can be used depending on the manner of processing of the workpiece 24.

By way of example, it would be conceivable for the force drive 58 to apply lower forces when it is merely intended to clamp the workpiece 24 between the upper beam tool 20 and the lower beam tool 22, whereas greater forces are applied when it is intended to deform the workpiece 24 by the action of the upper beam tool 20 and the lower beam tool 22 instead of just clamping the workpiece 24.

Figure 7:
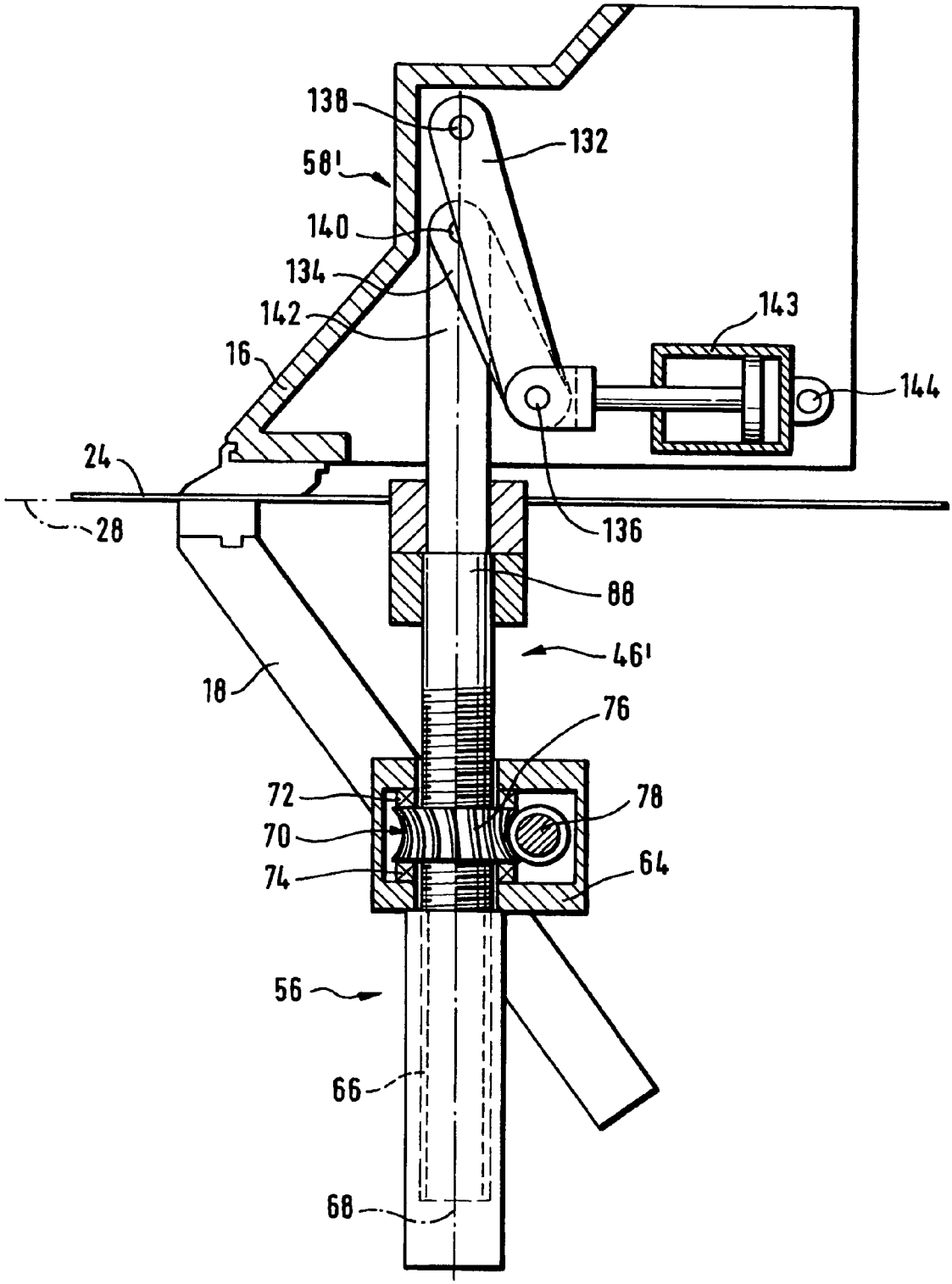
FIG. 7 shows a section similar to that shown in FIG. 3 through a second exemplary embodiment of a bending machine according to the invention.

In a second exemplary embodiment of a bending machine according to the invention, illustrated in FIG. 7, in the drive unit 46' the displacement drive 56 is formed in the same way as in the first exemplary embodiment. By contrast, the force drive 58' is not formed as a direct-acting hydraulic drive, but rather as a lever transmission 130 having a long lever 132 and a short lever 134, in which case, starting from a common pivotal connection point 136, the long lever 132 is connected to the upper beam 16 by means of a pivot point 138, whereas the short lever is connected to a force-transmission rod 142 by means of a pivot point 140, the force-transmission rod 142 for its part in turn being connected to the end 88 of the threaded spindle 66.

Displacement of the common articulation point 136 in the direction toward a dead center position and away from the latter therefore makes it possible to vary the distance between the pivot points 138 and 140 and therefore likewise to generate a great force for moving the upper beam 16 relative to the lower beam 18.

For this purpose, a linear drive 142 is provided for moving the pivot point 136, which linear drive may, for example, be a hydraulic drive, or alternatively may also be a spindle drive. For its part, the linear drive 142 is likewise connected to the upper beam 16, via a pivot point 144, and can therefore move with the upper beam 16.

Figure 8:
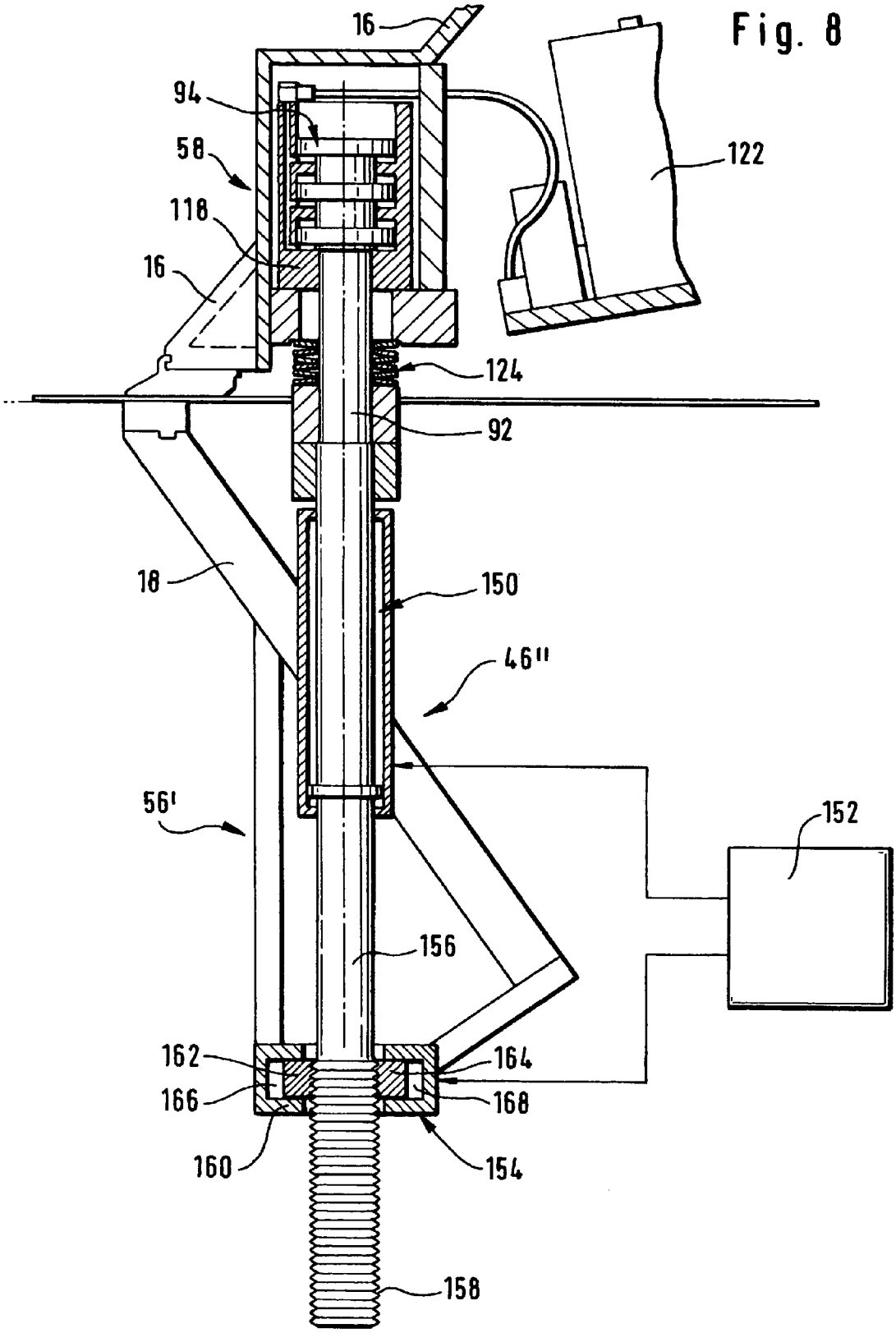
FIG. 8 shows a section similar to that shown in FIG. 3 through a third exemplary embodiment of a bending machine according to the invention.

In a third exemplary embodiment of a bending machine according to the invention, illustrated in FIG. 8, each of the drive units in this case comprises the drive unit 46", a force drive 58, which corresponds to that of the first exemplary embodiment, while the displacement drive 56' is formed by a hydraulic cylinder 150, which can be fed by a hydraulic unit 152 in order to move the upper beam 16 upward and downward away from the lower beam 18.

To allow the force drive 58 to be used when the hydraulic cylinder 150 is stationary, the hydraulic cylinder 150 must likewise be able to absorb the forces applied by the force drive 58. Since this can only be realized with difficulty using the hydraulic cylinder 150, the displacement drive 56' is provided with a blocking device 154. The latter comprises on the one hand a toothed rod 158 arranged as an extension of a piston rod 156 of the hydraulic cylinder 150 and two holding jaws 162 and 164, which are toothed on the front side, are disposed in a housing 160 that has the toothed rod 158 passing through it, and can be moved toward or away from the toothed rod 158 by means of pressure chambers 166 and 168, respectively, with the holding jaws 162 and 164 engaging in a positively locking manner in the toothed rod 158 in the position in which they are forced toward the toothed rod 158.

As soon as the hydraulic cylinder 150 becomes stationary, therefore, the holding jaws 162 and 164 are pressed onto the toothed rod 158 by the hydraulic unit 152 and thereby fix it in a positively locking manner with respect to the housing 160 and therefore with respect to the lower beam 18.

If the displacement drive is to be moved, the application of pressure to the holding jaws 162 and 164 is released, and therefore so is the positively locking fixing of the toothed rod 158 relative to the lower beam 18, so that the displacement drive 56' can operate under the action of the hydraulic cylinder 150.

It is preferable for the hydraulic unit 152 to be operated in such a way that it inevitably activates the blocking device 154 each time the hydraulic cylinder 150 is stationary, and therefore the displacement drive 56' is automatically blocked with respect to movement when the hydraulic cylinder 150 is stationary, so that in a stationary position the displacement drive 56' is always able to absorb the forces which may be generated by the force drive 58.

In both the second exemplary embodiment and the third exemplary embodiment, the operation of the displacement drives 56, 56' and of the force drives 58, 58' can take place in the same way as in the first exemplary embodiment, by means of the control unit 42, and consequently in this respect reference is made in full to the statements made in connection with the first exemplary embodiment.

The invention claimed is:

1. Bending machine comprising a machine frame, a bending beam moveable relative to said machine frame for bending a workpiece made from flat material, an upper beam having an upper beam tool and a lower beam having a lower beam tool, the upper beam and the lower beam being disposed such that they can move relative to one another on the machine frame, and at least one drive for moving the upper beam tool and the lower beam tool toward one another in order to clamp said workpiece made from flat material and located between the two beams during a bending operation by said bending beam, the at least one drive comprising at least one displacement drive for generating an opening and closing movement of the upper beam and the lower beam relative to one another and at least one force drive for generating a greater force than the displacement drive, said force drive being adapted to be used at least in order to cause a deformation of a portion of the workpiece disposed between the upper beam tool and the lower beam tool, said deformation being separate from said bending operation and the displacement drive being stationary and blocked during said deformation.

2. Bending machine according to claim 1, wherein the force drive is formed such that during the generation of a force which moves the upper beam tool and the lower beam tool toward one another its speed of displacement is lower than that of the displacement drive.

3. Bending machine according to claim 1, wherein the force that can be generated by the force drive exceeds the force that can be generated by the displacement drive by a factor of at least two.

4. Bending machine according to claim 1, wherein the at least one drive, which comprises in each case one displacement drive and one force drive, is disposed at an end of the upper beam and of the lower beam.

5. Bending machine according to claim 4, wherein in each case one of the drives is disposed on both sides of the upper beam and the lower beam.

6. Bending machine according to claim 1, wherein the force drive and the displacement drive are combined to form a drive unit which as a whole is operative only between the upper beam and the lower beam.

7. Bending machine according to claim 1, wherein the displacement drive comprises a blocking device which is active when the drive is stationary.

8. Bending machine according to claim 1, wherein the displacement drive is blocked by a self-locking action when it is stationary.

9. Bending machine according to claim 1, wherein the displacement drive is formed as a spindle drive, comprising a threaded spindle and a spindle nut.

10. Bending machine according to claim 9, wherein the spindle nut is drivable by a drive motor.

11. Bending machine according to claim 9, wherein the spindle nut is driven by means of a self-locking transmission.

12. Bending machine according to claim 1, wherein the force drive is formed as a hydraulic drive.

13. Bending machine according to claim 12, wherein the hydraulic drive comprises a plurality of piston surfaces which act in parallel.

14. Bending machine according to claim 12, wherein the hydraulic drive is disposed so as to act directly in the drive unit.

15. Bending machine according to claim 12, wherein a hydraulic unit of the hydraulic drive is disposed at one of the beams.

16. Bending machine according to claim 1, wherein a control unit is provided, which actuates either the displacement drive or the force drive.

17. Bending machine according to claim 16, wherein the force that can be generated by the force drive can be controlled by the control unit.

18. Bending machine according to claim 16, wherein the control unit actuates the force drive as a function of the respective processing operation.

19. Bending machine according to claim 16, wherein the control unit finally actuates the force drive during clamping of the workpiece in order for the latter to be bent by means of a bending beam.

20. Bending machine according to claim 16, wherein the control unit finally uses the force drive each time the workpiece is acted on by means of the upper beam tool and the lower beam tool in order to be processed.

21. Bending machine comprising a machine frame an upper beam having an upper beam tool and a lower beam having a lower beam tool, the upper beam and the lower beam being disposed such that they can move relative to one another on the machine frame, and at least one drive for moving the upper beam tool and the lower beam tool toward one another in order to act on a workpiece made from flat material and located between the two beams, the at least one drive comprising at least one displacement drive for generating an opening and closing movement of the upper beam and the lower beam relative to one another and at least one force drive for generating a greater force than the displacement drive in order to deform the workpiece disposed between the upper beam tool and the lower beam tool, and the displacement drive being stationary and blocked during deformation, and wherein the force drive comprises a lever transmission with a drive.

* * * * *

UNITED STATES PATENT AND TRADEMARK OFFICE

CERTIFICATE OF CORRECTION

PATENT NO. : 7,069,762 B2
APPLICATION NO. : 11/088590
DATED : July 4, 2006
INVENTOR(S) : Wolfgang Kutschker It is certified that error appears in the above-identified patent and that said Letters Patent is hereby corrected as shown below:

On The Title Page, Item (73) Assignee "RAS Reinhardt Maschinebau GmbH" should read --RAS Reinhardt Maschinenbau GmbH--.

Signed and Sealed this

Twenty-fourth Day of July, 2007

JON W. DUDAS
*Director of the United States Patent and Trademark Office*